US009218016B2

(12) United States Patent
Pan

(10) Patent No.: US 9,218,016 B2
(45) Date of Patent: Dec. 22, 2015

(54) VOLTAGE REFERENCE GENERATION CIRCUIT USING GATE-TO-SOURCE VOLTAGE DIFFERENCE AND RELATED METHOD THEREOF

(71) Applicant: FSP TECHNOLOGY INC., Taoyuan County (TW)

(72) Inventor: Sheng-Wen Pan, Taoyuan County (TW)

(73) Assignee: FSP TECHNOLOGY INC., Taoyuan, Taoyuan County (TW)

( * ) Notice: Subject to any disclaimer, the term of this patent is extended or adjusted under 35 U.S.C. 154(b) by 369 days.

(21) Appl. No.: 13/753,490

(22) Filed: Jan. 29, 2013

(65) Prior Publication Data

US 2013/0193935 A1 Aug. 1, 2013

(30) Foreign Application Priority Data

Jan. 31, 2012 (TW) ..... 101103038 A

(51) Int. Cl.

| | |
|---|---|
| ***G05F 1/56*** | (2006.01) |
| ***G05F 5/00*** | (2006.01) |
| ***G05F 1/10*** | (2006.01) |
| ***G05F 3/24*** | (2006.01) |

(52) U.S. Cl.
CPC .. *G05F 5/00* (2013.01); *G05F 1/10* (2013.01); *G05F 3/242* (2013.01)

(58) Field of Classification Search
USPC ..... 323/268–285, 299, 311–317; 327/538–543
See application file for complete search history.

(56) References Cited

U.S. PATENT DOCUMENTS

| | | | | |
|---|---|---|---|---|
| 4,994,688 | A * | 2/1991 | Horiguchi et al. | 327/541 |
| 5,311,115 | A * | 5/1994 | Archer | 323/315 |
| 5,373,226 | A * | 12/1994 | Kimura | 323/313 |
| 5,376,839 | A * | 12/1994 | Horiguchi et al. | 327/541 |
| 5,432,432 | A * | 7/1995 | Kimura | G05F 3/245 323/313 |
| 5,434,533 | A * | 7/1995 | Furutani | 327/538 |
| 5,886,567 | A * | 3/1999 | Park | G01R 19/16519 327/535 |
| 5,894,236 | A * | 4/1999 | Mizoguchi et al. | 327/108 |
| 6,144,249 | A * | 11/2000 | Tse | 327/539 |
| 6,177,788 | B1 * | 1/2001 | Narendra | G05F 3/262 323/315 |
| 6,344,769 | B1 * | 2/2002 | Giuroiu | 327/538 |
| 6,466,081 | B1 * | 10/2002 | Eker | G05F 1/56 327/539 |
| 6,747,508 | B2 * | 6/2004 | Liu et al. | 327/543 |
| 6,831,504 | B1 * | 12/2004 | Holloway et al. | 327/541 |
| 7,034,514 | B2 * | 4/2006 | Tachibana et al. | 323/313 |
| 7,042,205 | B2 * | 5/2006 | Tseng | G05F 3/262 323/313 |
| 7,109,785 | B2 * | 9/2006 | Derksen | 327/543 |
| 7,132,821 | B2 * | 11/2006 | Camara et al. | 323/315 |
| 7,276,890 | B1 * | 10/2007 | Kumar | 323/313 |

(Continued)

*Primary Examiner* — Adolf Berhane
*Assistant Examiner* — Nusrat Quddus
(74) *Attorney, Agent, or Firm* — Winston Hsu; Scott Margo

(57) ABSTRACT

A voltage reference generation circuit includes a current supply circuit and a core circuit. The current supply circuit is arranged to provide a plurality of currents. The core circuit is coupled to the current supply circuit, and arranged to receive the currents and accordingly generate a voltage reference. The core circuit includes a first transistor, a second transistor and a third transistor, wherein the first transistor and the third transistor generate a first gate-to-source voltage and a third gate-to-source voltage, respectively, according to a first current of the received currents; the second transistor generates a second gate-to-source voltage according to a second current of the received currents; and the voltage reference is generated according to the first gate-to-source voltage, the second gate-to-source voltage and the third gate-to-source voltage.

16 Claims, 12 Drawing Sheets

(56) References Cited

U.S. PATENT DOCUMENTS

| | | | | |
|---|---|---|---|---|
| 7,408,388 | B2 * | 8/2008 | Nagasawa et al. | 327/110 |
| 8,350,418 | B2 * | 1/2013 | Metzger et al. | 307/150 |
| 2002/0027470 | A1 * | 3/2002 | Narendra | G05F 3/262 327/541 |
| 2004/0263144 | A1 * | 12/2004 | Tseng | G05F 3/262 323/313 |
| 2009/0267655 | A1 * | 10/2009 | Chen | G09G 3/3696 327/108 |
| 2010/0066457 | A1 * | 3/2010 | Muller | H03K 4/502 331/111 |
| 2011/0227636 | A1 * | 9/2011 | Endo et al. | 327/541 |
| 2014/0091780 | A1 * | 4/2014 | Hu | G05F 1/462 323/314 |

* cited by examiner

VOLTAGE REFERENCE GENERATION CIRCUIT USING GATE-TO-SOURCE VOLTAGE DIFFERENCE AND RELATED METHOD THEREOF

BACKGROUND OF THE INVENTION

1. Field of the Invention

The disclosed embodiments of the present invention relate to voltage reference generation mechanism, and more particularly, to a voltage reference generation circuit with a low temperature coefficient, low line regulation and/or a wideband high power supply rejection ratio, and related voltage reference generation method, voltage regulation circuit and voltage regulation method.

2. Description of the Prior Art

In order to design a voltage reference generation circuit with a lower temperature coefficient, a bipolar junction transistor (BJT), a diode, and a depletion-mode metal-oxide-semiconductor field effect transistor (MOSFET) are usually used for temperature compensation. For example, a BJT is used in a conventional bandgap voltage reference circuit for temperature compensation. As it is expensive to fabricate a BJT with a bipolar complementary metal-oxide-semiconductor (BiCMOS) process, the parasitic effect of the standard complementary metal-oxide-semiconductor (CMOS) process is commonly used for BJT fabrication. However, because a base of the fabricated parasitic BJT has to be connected to ground and occupies a large area, the voltage reference circuit fabricated with the above process may have limited application.

Please refer to FIG. 1, which is a diagram illustrating a partial circuit of a conventional voltage reference generation circuit. The voltage reference generation circuit 100 includes a current supply circuit 110 and a core circuit 120. The current supply circuit 110 includes a plurality of MOSFETs M1-M5 and a resistor R1, and is arranged to provide a current to the core circuit 120. The core circuit 120 includes a plurality of MOSFETs M6-M7 and a plurality of resistors R2-R3, and is arranged to generate a voltage reference V_REF by using the resistors R2-R3 and temperature dependences of the MOSFETs M6-M7. However, the voltage reference generation circuit 100 needs at least three current paths (i.e. respective flow paths of currents I1-I3), and a power supply rejection ratio (PSRR) of the voltage reference generation circuit 100 is reduced due to the resistors R2 and R3. Thus, not only does the voltage reference generation circuit 100 consume more energy, but the variation of the voltage reference V_REF due to a power supply VDD will be apparent.

In order to enhance a PSRR of a voltage reference generation circuit, a core circuit of the voltage reference generation circuit is usually connected to a pre-regulator circuit. Please refer to FIG. 2, which is a diagram illustrating a partial circuit of another conventional voltage reference generation circuit. The voltage reference generation circuit 200 includes a plurality of MOSFETs M1-M18, a plurality of BJTs Q1-Q5, and a plurality of resistors R1 and R2, wherein the voltage reference generation circuit 200 is arranged to generate a regulated voltage V_REG by using a pre-regulator circuit, and accordingly suppress disturbance (from a power supply VDD) in a voltage reference V_REF. By analyzing the circuit shown in FIG. 2, a person skilled in the art can find that lots of transistors are needed, and positive and negative feedback effects are generated simultaneously in the voltage reference generation circuit 200. Thus, the circuit needs to be modified to make the positive feedback effect weaker than the negative one. In addition, when the voltage reference generation circuit 200 operates at a higher operation frequency, the PSRR would be greatly reduced, resulting in limited wideband application of the voltage reference generation circuit 200.

Please refer to FIG. 3, which is a diagram illustrating a partial circuit of another conventional voltage reference generation circuit. The voltage reference generation circuit 300 includes a plurality of MOSFETs M1-M12, a resistor R1 and a plurality of capacitors C1 and C2. The circuit architecture shown in FIG. 3 may enhance the PSRR of the voltage reference generation circuit 300 and reduce the number of used transistors. Unfortunately, the voltage reference generation circuit 300 exhibits higher sensitivity to temperature variations. Moreover, each of the voltage reference generation circuits 100-300 shown in FIGS. 1-3 may generate a body effect, which changes a corresponding threshold voltage.

Thus, how to implement a voltage reference generation circuit having a low temperature coefficient, a high PSRR, low fabrication cost and a weak body effect is a problem that needs to be solved.

SUMMARY OF THE INVENTION

In accordance with exemplary embodiments of the present invention, a voltage reference generation circuit, a voltage reference generation method thereof, a related voltage regulation circuit and a voltage regulation method thereof are proposed to solve the above-mentioned problem, wherein the voltage reference generation circuit is implemented by fewer current paths, a combination of gate-to-source voltages of transistors, and feedback circuits having common-source configurations.

According to an embodiment of the present invention, an exemplary voltage reference generation circuit is disclosed. The exemplary voltage reference generation circuit includes a current supply circuit and a core circuit. The current supply circuit is arranged for providing a plurality of currents. The core circuit is coupled to the current supply circuit, and is arranged for receiving the currents and generating a voltage reference according to the received currents. The core circuit includes a first transistor, a second transistor and a third transistor. The first transistor and the third transistor generate a first gate-to-source voltage and a third gate-to-source voltage, respectively, according to a first current of the received currents; the second transistor generates a second gate-to-source voltage according to a second current of the received currents; and the voltage reference is generated according to the first gate-to-source voltage, the second gate-to-source voltage and the third gate-to-source voltage.

According to an embodiment of the present invention, an exemplary voltage regulation circuit is disclosed. The exemplary voltage regulation circuit includes a first feedback circuit and a second feedback circuit. The first feedback circuit has a common-source configuration, and is arranged for receiving at least a first specific voltage to generate a second specific voltage, wherein the first specific voltage is generated according to an unregulated voltage. The second feedback circuit has a common-source configuration, and is arranged for receiving the second specific voltage to generate a regulated voltage.

According to an embodiment of the present invention, an exemplary voltage reference generation circuit is disclosed. The exemplary voltage reference generation circuit includes a voltage regulation circuit, a current supply circuit and a core circuit. The voltage regulation circuit includes a first feedback circuit and a second feedback circuit. The first feedback circuit has a common-source configuration, and is arranged for receiving at least a first specific voltage to generate a second specific voltage, wherein the first specific voltage is generated according to an unregulated voltage. The second feedback circuit has a common-source configuration, and is arranged for receiving the second specific voltage to generate a regulated voltage. The current supply circuit is coupled to the voltage regulation circuit, and is arranged for receiving the regulated voltage to provide a plurality of currents. The core circuit is coupled to the voltage regulation circuit and the current supply circuit, and is arranged for receiving the currents to generate the first specific voltage and a voltage reference.

According to an embodiment of the present invention, an exemplary voltage reference generation method is disclosed. The exemplary voltage reference generation method includes the following steps: providing a plurality of currents; using a first transistor and a third transistor to generate a first gate-to-source voltage and a third gate-to-source voltage, respectively, according to a first current of the received currents; using a second transistor to generate a second gate-to-source voltage according to a second current of the received currents; and generating a voltage reference according to the first gate-to-source voltage, the second gate-to-source voltage and the third gate-to-source voltage.

According to an embodiment of the present invention, an exemplary voltage regulation method is disclosed. The exemplary voltage regulation method includes the following steps: using a first feedback circuit having a common-source configuration to receive a first specific voltage and accordingly generate a second specific voltage, wherein the first specific voltage is generated according to an unregulated voltage; and using a second feedback circuit having a common-source configuration to receive a second specific voltage and accordingly generate a regulated voltage.

According to an embodiment of the present invention, an exemplary voltage reference generation method is disclosed. The exemplary voltage reference generation method includes the following steps: using a first feedback circuit having a common-source configuration to receive a first specific voltage and accordingly generate a second specific voltage, wherein the first specific voltage is generated according to an unregulated voltage; using a second feedback circuit having a common-source configuration to receive a second specific voltage and accordingly generate a regulated voltage; receiving the regulated voltage to provide a plurality of currents; and receiving the currents and accordingly generating the first specific voltage and a voltage reference.

The proposed voltage reference generation circuit has a low temperature coefficient, a wideband high PSRR, low fabrication cost, a weak body effect and/or low line regulation, and therefore provides a solution to power supply noise suppression in wideband application.

These and other objectives of the present invention will no doubt become obvious to those of ordinary skill in the art after reading the following detailed description of the preferred embodiment that is illustrated in the various figures and drawings.

DETAILED DESCRIPTION

First, in accordance with an embodiment of the present invention, a circuit architecture which may enhance a PSRR without voltage regulation is disclosed. Please refer to FIG. 4, which is a block diagram illustrating an exemplary generalized voltage reference generation circuit according to an embodiment of the present invention. The voltage reference generation circuit 400 may include a current supply circuit 410 and a core circuit 420. The core circuit 420 may include, but is not limited to, a first transistor M1, a second transistor M2 and a third transistor M3. The current supply circuit 410 is arranged to provide a plurality of currents including a first current I1 and a second current I2. The core circuit 420, coupled to the current supply circuit 410, is arranged to receive the currents including the first current I1 and the second current I2, and generate a voltage reference V_REF according to the received currents. More specifically, the first transistor M1 and the third transistor M3 generate a first gate-to-source voltage VGS1 and a third gate-to-source voltage VGS3, respectively, according to the first current I1; the second transistor M2 generates a second gate-to-source voltage VGS2 according to the second current I2; and the voltage reference V_REF is generated according to the first gate-to-source voltage VGS1, the second gate-to-source voltage VGS2 and the third gate-to-source voltage VGS3. For example, the voltage reference V_REF may be represented as a function of the above gate-to-source voltages: V_REF=f (VGS1, VGS2, VGS3). Since the gate-to-source voltages may be adjusted according to the fabrication process and the currents supplied by the current supply circuit 410, and noise disturbances from the power supply may be reduced by replacing resistive elements with transistors appropriately, the generated voltage reference V_REF may have a low value and reduced noise disturbances.

Figure 1:
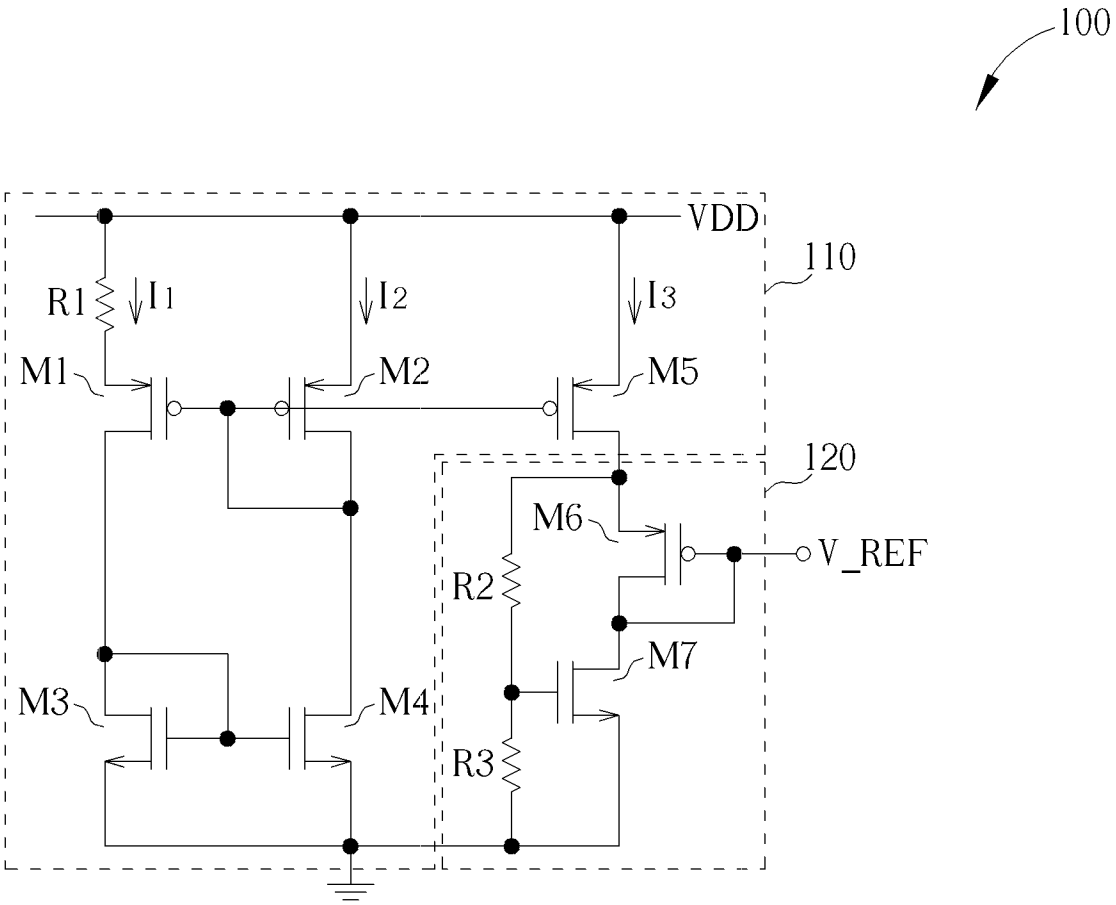
FIG. 1 PRIOR ART
FIG. 1 is a diagram illustrating a partial circuit of a conventional voltage reference generation circuit.
Figure 2:
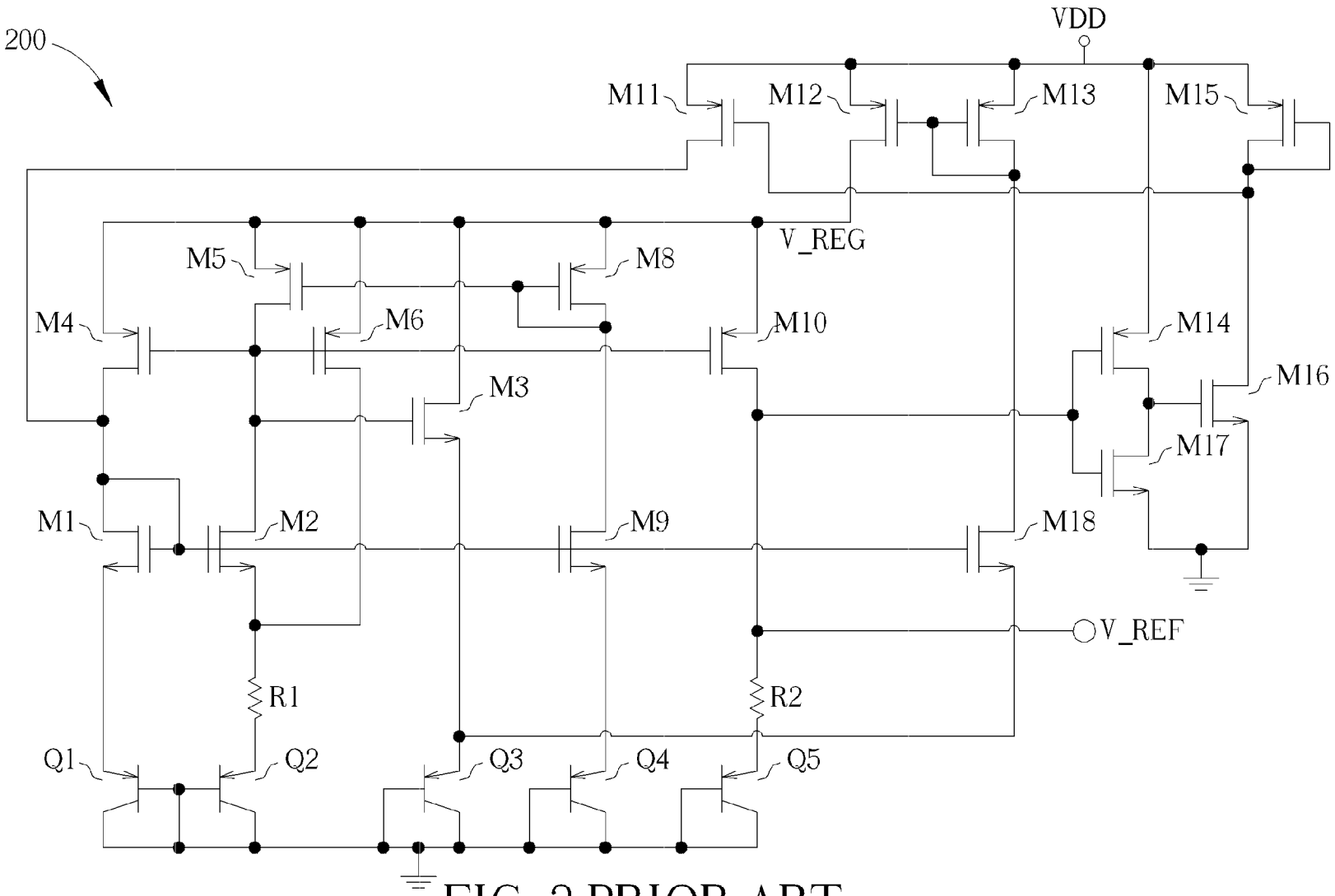
FIG. 2 PRIOR ART
FIG. 2 is a diagram illustrating a partial circuit of another conventional voltage reference generation circuit.
Figure 3:
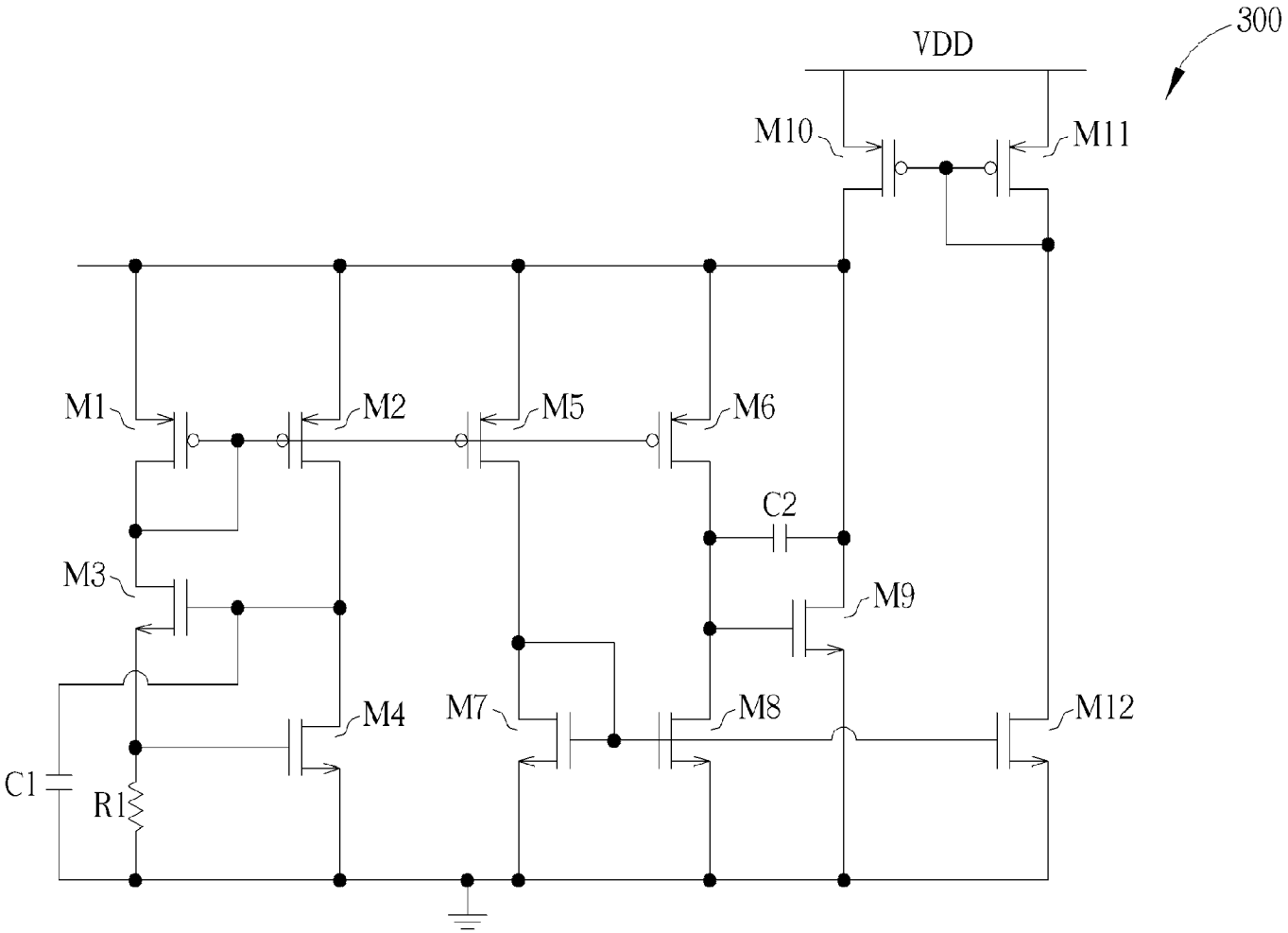
FIG. 3 PRIOR ART
FIG. 3 is a diagram illustrating a partial circuit of another conventional voltage reference generation circuit.
Figure 4:
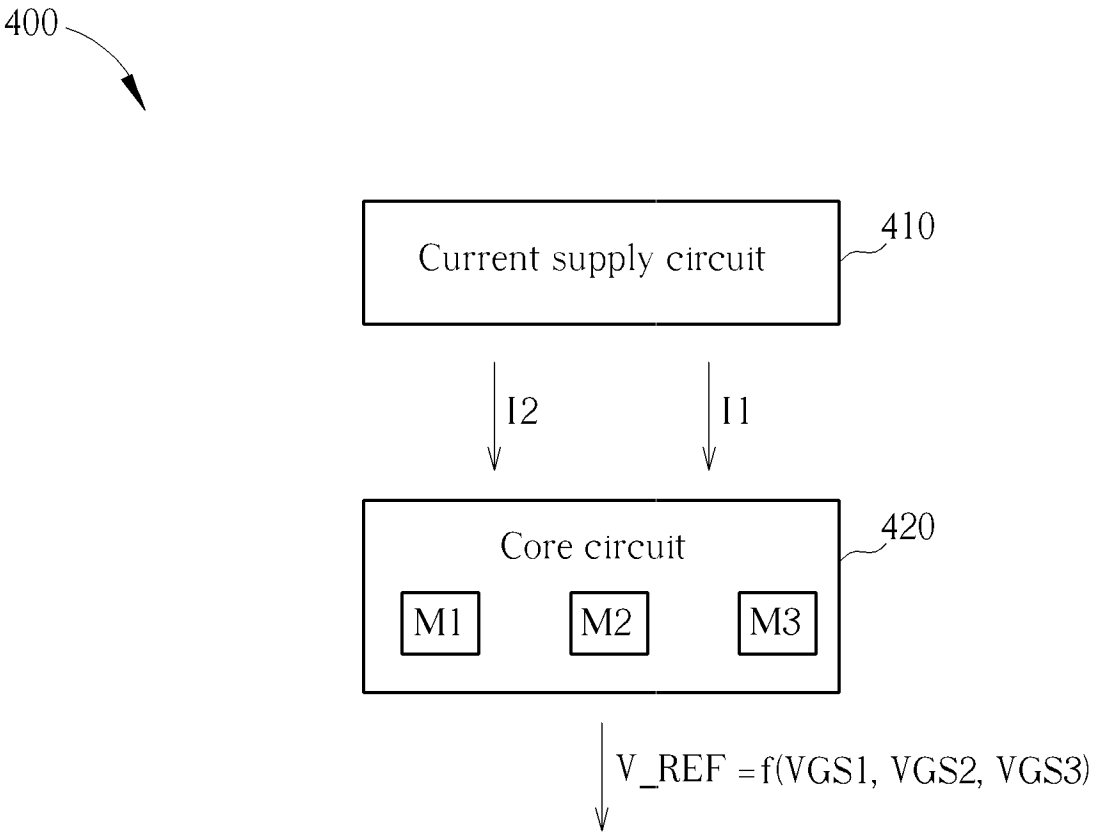
FIG. 4 is a block diagram illustrating an exemplary generalized voltage reference generation circuit according to an embodiment of the present invention.
Figure 5:
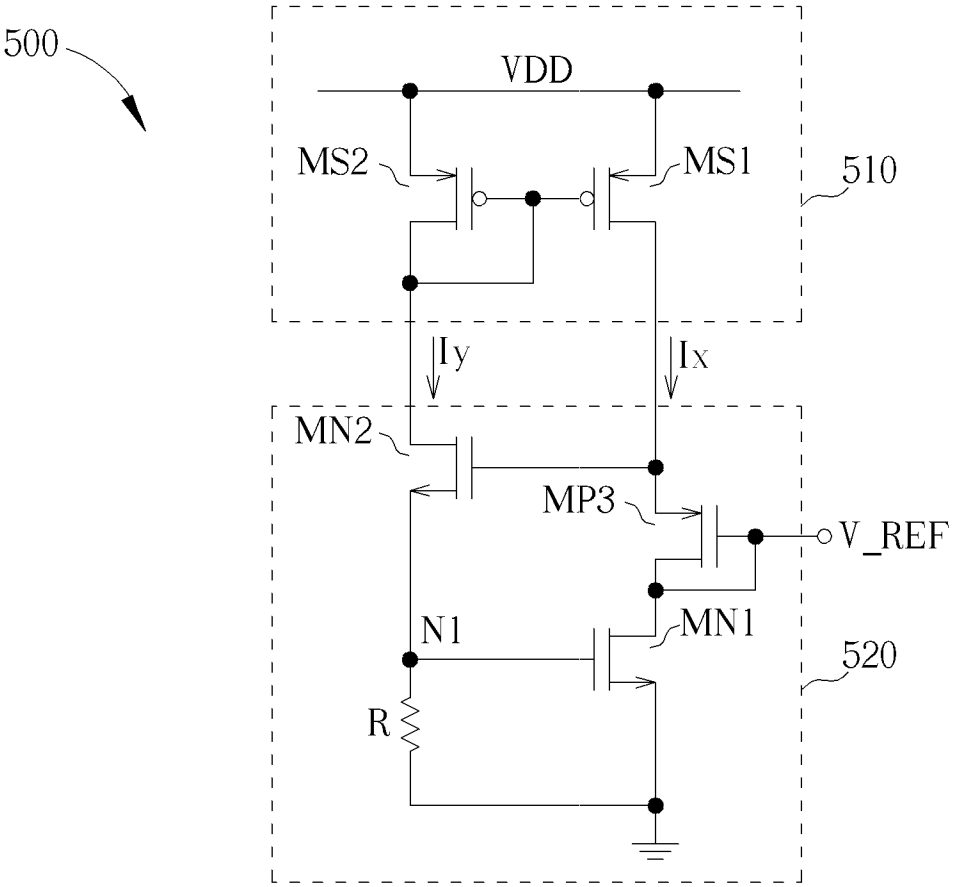
FIG. 5 is a diagram illustrating an implementation of the voltage reference generation circuit shown in FIG. 4.

Please refer to FIG. 5, which is a diagram illustrating an implementation of the voltage reference generation circuit 400 shown in FIG. 4. The voltage reference generation circuit 500 may include, but is not limited to, a current supply circuit 510 and a core circuit 520. In this implementation, the core circuit 520 includes a first transistor MN1, a second transistor MN2 and a third transistor MP3. The first transistor MN1 includes a first gate, a first drain and a first source; the second transistor MN2 includes a second drain, a second gate and a second source, wherein the second drain receives a second current Iy generated from the current supply circuit 510, and the second source is coupled to the first gate; and the third transistor MP3 includes a third gate, a third drain and a third source, wherein the third source receives a first current Ix generated from the current supply circuit 510, the third source is coupled to the second gate, and the third gate and the third drain are coupled to the first drain. As the first source is coupled to ground, a relation between a voltage reference V_REF (generated from the third gate) and gate-to-source voltages (i.e. a first gate-to-source voltages VGS1 of the first transistor MN1, a second gate-to-source voltages VGS2 of the second transistor MN2 and a third gate-to-source voltages VGS3 of the third transistor MP3) may be represented as V_REF=VGS1+VGS2+VGS3. Please note that, in this implementation, the first transistor MN1 and the second transistor MN2 are n-type doped, and a doping type of the third transistor MP3 is p-type doping (different from doping types of the first transistor MN1 and the second transistor MN2). Hence, the third gate-to-source VGS3 is negative (i.e., VGS3=−|VGS3|), and each of the first gate-to-source VGS1 and the second gate-to-source VGS2 is positive. The above relation of the voltage reference may therefore also be represented as V_REF=|VGS1|+|VGS2|−|VGS3|.

In addition, the current supply circuit 510 may include a current mirror circuit composed of a fourth transistor MS1 and a fifth transistor MS2. The current mirror circuit receives a power supply VDD to provide only the first current Ix and the second current Iy to the core circuit 520, and the core circuit 520 determines the voltage reference V_REF according to the first current Ix and the second current Iy only. It should be noted that the above is for illustrative purposes only, and is not meant to be a limitation of the present invention. In an alternative design, other circuit architectures may be employed to implement the current supply circuit 510. For example, a folded cascade circuit may be employed to provide needed current(s). In addition, the doping types of the first transistor MN1, the second transistor MN2 and the third transistor MP3 may be adjusted according to different circuit designs. In another alternative design, besides a specific combination of the gate-to-source voltages VGS1-VGS3 (i.e. |VGS1|+|VGS2|−|VGS3|), the voltage reference V_REF may be determined according to other combinations in appropriate circuit designs (e.g. V_REF=|VGS1|−|VGS2|−|VGS3|). In addition, the first source of the first transistor MN1 may also be coupled to a non-ground voltage to thereby adjust an output level of the voltage reference V_REF.

It should be noted that the core circuit 520 may reduce the temperature sensitivity of the voltage reference V_REF by cascading the above transistors appropriately. For example, a threshold voltage $V_{thn}$ of an n-type doped transistor and a threshold voltage $V_{thp}$ of a p-type doped transistor may be represented as functions of temperature:

$$V_{thn}(T)=V_{thn}(T_0)-\beta_{vthn}(T-T_0) \text{ and}$$

$$|V_{thp}(T)|=|V_{thp}(T_0)|-\beta_{vthp}(T-T_0),$$

wherein $\beta_{vthn}$ and $\beta_{vthp}$ are temperature coefficients of the threshold voltages $V_{thn}$ and $V_{thp}$, respectively, and T and $T_0$ are current temperature and reference temperature, respectively. Additionally, electron mobility of the n-type doped transistor $\mu_n$ and hole mobility of the p-type doped transistor $\mu_p$ may be represented as functions of temperature:

$$\mu_n(T) = \frac{\mu_n(T_0)}{(T/T_0)^{-\beta_{\mu n}}}$$

and $$\mu_p(T) = \frac{\mu_p(T_0)}{(T/T_0)^{-\beta_{\mu p}}},$$

wherein $\beta_{\mu n}$ and $\beta_{\mu p}$ are temperature coefficients of the electron mobility $\mu_n$ and the hole mobility $\mu_p$, respectively. In the implementation in FIG. 5, based on the following expression:

$$\frac{\partial \text{V_REF}}{\partial T} = \frac{\partial VGS1}{\partial T} + \frac{\partial VGS2}{\partial T} - \frac{\partial |VGS3|}{\partial T},$$

it can be derived that $$\frac{\partial \text{V_REF}}{\partial T} = [-(\beta_{vthn1}+\beta_{vthn2})+\beta_{vthp3}] + \frac{\beta_{\mu p}}{T_0} \times \sqrt{\frac{2I_D}{\mu_p C_{ox} T_0 \left(\frac{W}{L}\right)_{MP3}}} \times \left\{ \frac{\beta_{\mu n}}{\beta_{\mu p}} \times \sqrt{\left(\frac{T}{T_0}\right)^{(\beta_{\mu n}-1)} \times \left[\frac{\mu_p\left(\frac{W}{L}\right)_{MP3}}{\mu_n\left(\frac{W}{L}\right)_{MN1}} + \frac{\mu_p\left(\frac{W}{L}\right)_{MP3}}{\mu_n\left(\frac{W}{L}\right)_{MN1}}\right]} - \left(\frac{T}{T_0}\right)^{(\beta_{\mu p}-1)} \right\}$$

wherein $\beta_{vthn1}$, $\beta_{vthn2}$, and $\beta_{vthp3}$ are temperature coefficients of threshold voltages of the transistors MN1-MP3, respectively; $(W/L)_{MN1}$, $(W/L)_{MN2}$ and $(W/L)_{MP3}$ are aspect ratios of the transistors MN1-MP3, respectively; a value of the current $I_D$ equals to values of the currents Ix and Iy; and $C_{OX}$ is oxide capacitance. Based on the above expressions, the voltage reference V_REF having a low temperature coefficient may be obtained by adjusting process parameters and a supply current appropriately.

In addition, the core circuit 520 may obtain an improved PSRR by cascading transistors appropriately. As shown in FIG. 5, the core circuit 520 may further include a resistive element (e.g. a resistor R) coupled between the first source and the first gate of the first transistor MN1. The PSRR of the voltage reference generation circuit 500 is analyzed as follows from the perspective of a node N1. In FIG. 5, as each of the second transistor MN2 and the third transistor MP3 is a common-gate amplifier, the operation bandwidth is extended. A Miller effect generated in the first transistor MN1 may be reduced by connecting the third transistor MP3 as a diode. By cascading the transistors, the amount and the operation bandwidth of the $PSRR_{500}$ (i.e. the PSRR of the voltage reference generation circuit 500) may be enhanced. More specifically, by analyzing a small signal model of the voltage reference generation circuit 500, the $PSRR_{500}$ may be derived as $$\left|\frac{\Delta \text{V_REF}}{\Delta VDD}\right|_{500} \approx \left|g_{R_MS1} \times \frac{g_B + g_{MN2}}{g_{MN1} \times g_{MP3}} - \frac{g_{R_MN2} + g_{R_MS1}}{g_{MP3}}\right|,$$

wherein the $PSRR_{500}$ is derived in decibels (dB); $g_{R_MS1}$ and $g_{R_MN2}$ are output conductances of the transistor MS1 and MN2, respectively; $g_B$ is a reciprocal of the resistor R; and $g_{MN1}$, $g_{MN2}$ and $g_{MP3}$ are transconductances of the transistors MN1, MN2 and MP3, respectively. As a person skilled in the art can derive the above expression by using the small signal model and the Kirchhoff's law, the derivation procedure is omitted here for brevity.

Figure 6A:
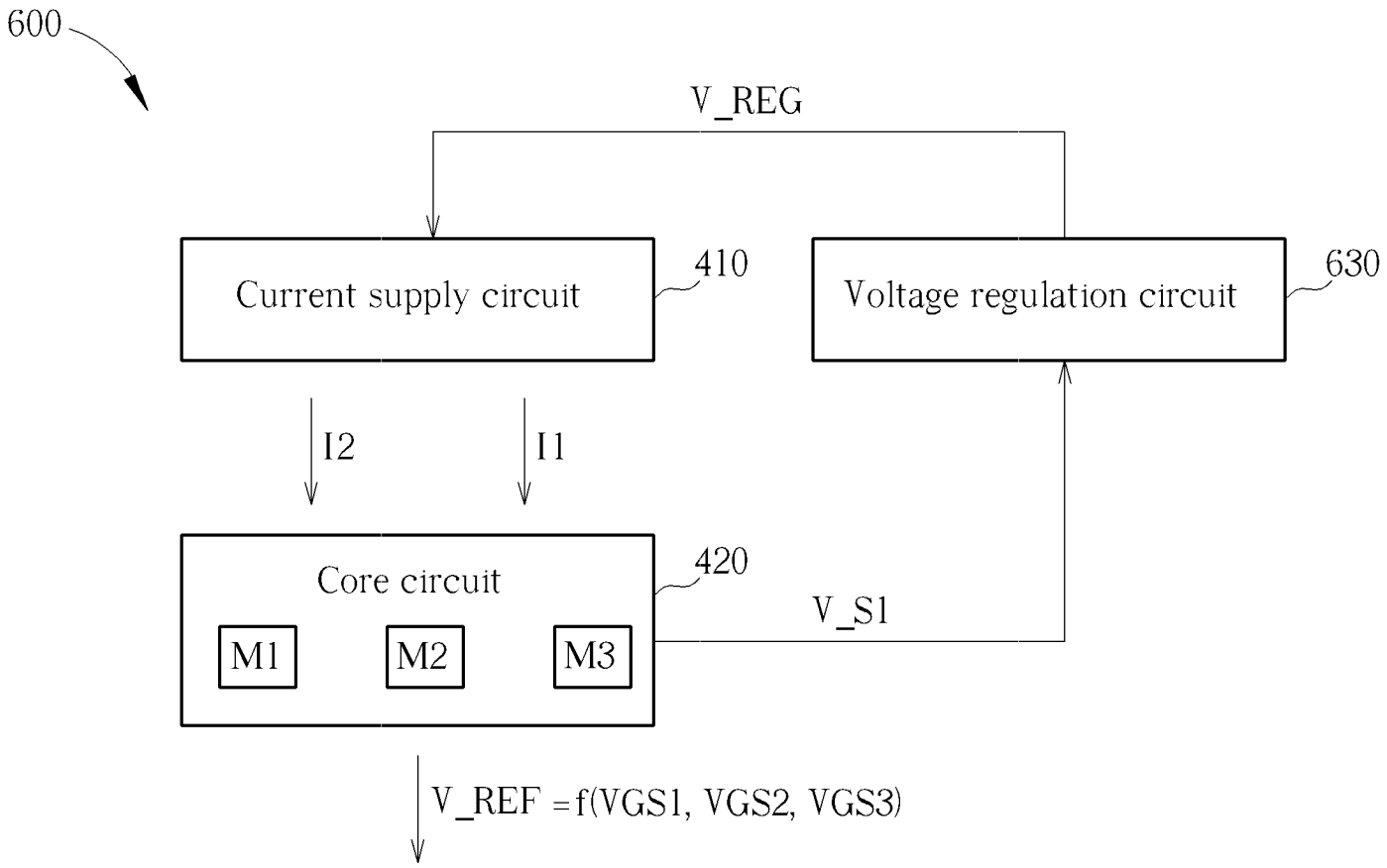
FIG. 6A is a block diagram illustrating an exemplary generalized voltage reference generation circuit according to another embodiment of the present invention.
Figure 6B:
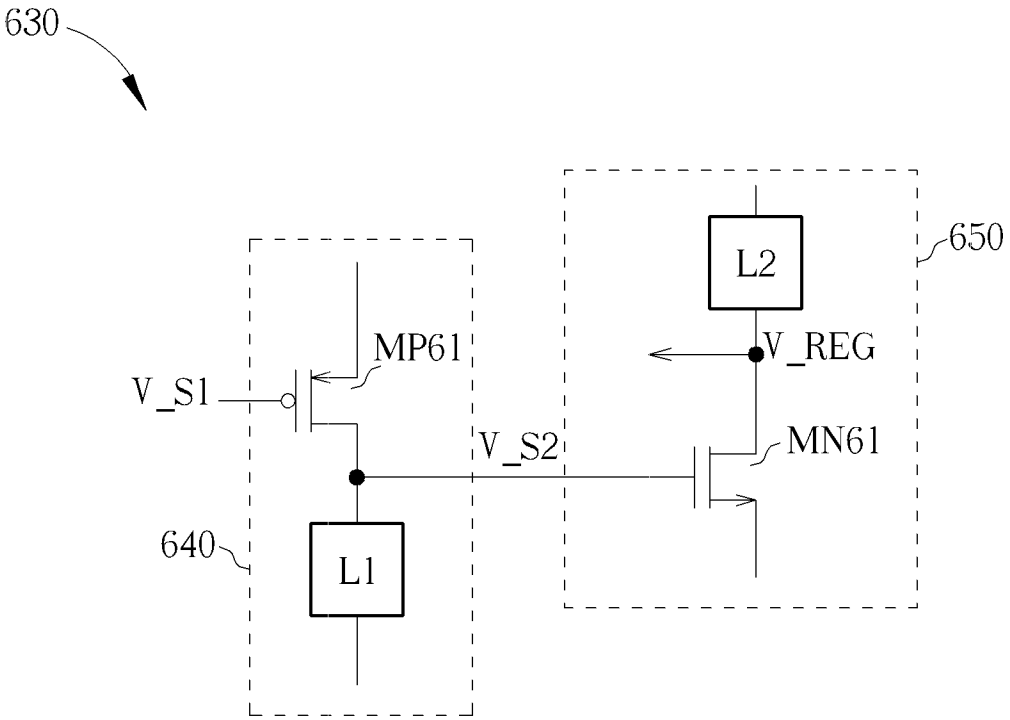
FIG. 6B is an implementation of a voltage regulation circuit shown in FIG. 6A.

As mentioned above, besides modifying the circuit design of the core circuit, the PSRR of the voltage reference generation circuit can be enhanced by coupling the core circuit to the voltage regulation circuit. Please refer to FIG. 6A and FIG. 6B together. FIG. 6A is a block diagram illustrating an exemplary generalized voltage reference generation circuit according to another embodiment of the present invention, and FIG. 6B is an implementation of a voltage regulation circuit shown in FIG. 6A. The voltage reference generation circuit 600 includes the current supply circuit 410 and the core circuit 420 shown in FIG. 4, and a voltage regulation circuit 630. The voltage regulation circuit 630 is coupled to the current supply circuit 410 and the core circuit 420, and includes a first feedback circuit 640 (having a common-source configuration) and a second feedback circuit 650 (having a common-source configuration). The first feedback circuit 640 is arranged for receiving a first specific voltage V_S1 to generate a second specific voltage V_S2, wherein the first specific voltage V_S1 is generated according to an unregulated voltage received by the current supply circuit 410. The second feedback circuit 650 is arranged for receiving the second specific voltage V_S2 to generate a regulated voltage V_REG. Before regulated, the regulated voltage V_REG is the unregulated voltage received by the current supply circuit 410.

In this embodiment, the first feedback circuit 640 may include a transistor MP61 and a load unit L1, and the second feedback circuit 650 may include a transistor MN61 and a load unit L2. As shown in FIG. 6B, a source of the transistor MP61 may be coupled to a highest bias voltage of the voltage reference generation circuit 600, and/or a source of the transistor MN61 may be coupled to a lowest bias voltage of the voltage reference generation circuit 600. In other words, the source of the transistor MP61 and the body of the transistor MP61 are at equal potential, and/or the source of the transistor MN61 and the body of the transistor MN61 are at equal potential. Thus, the body effect in the transistors of the voltage regulation circuit 630 may be neglected. It should be noted that each of the first feedback circuit 640 and the second feedback circuit 650 has the common-source configuration and is the negative feedback circuit, so the power supply disturbance imposed on the regulated voltage V_REG may be suppressed effectively.

Figure 7:
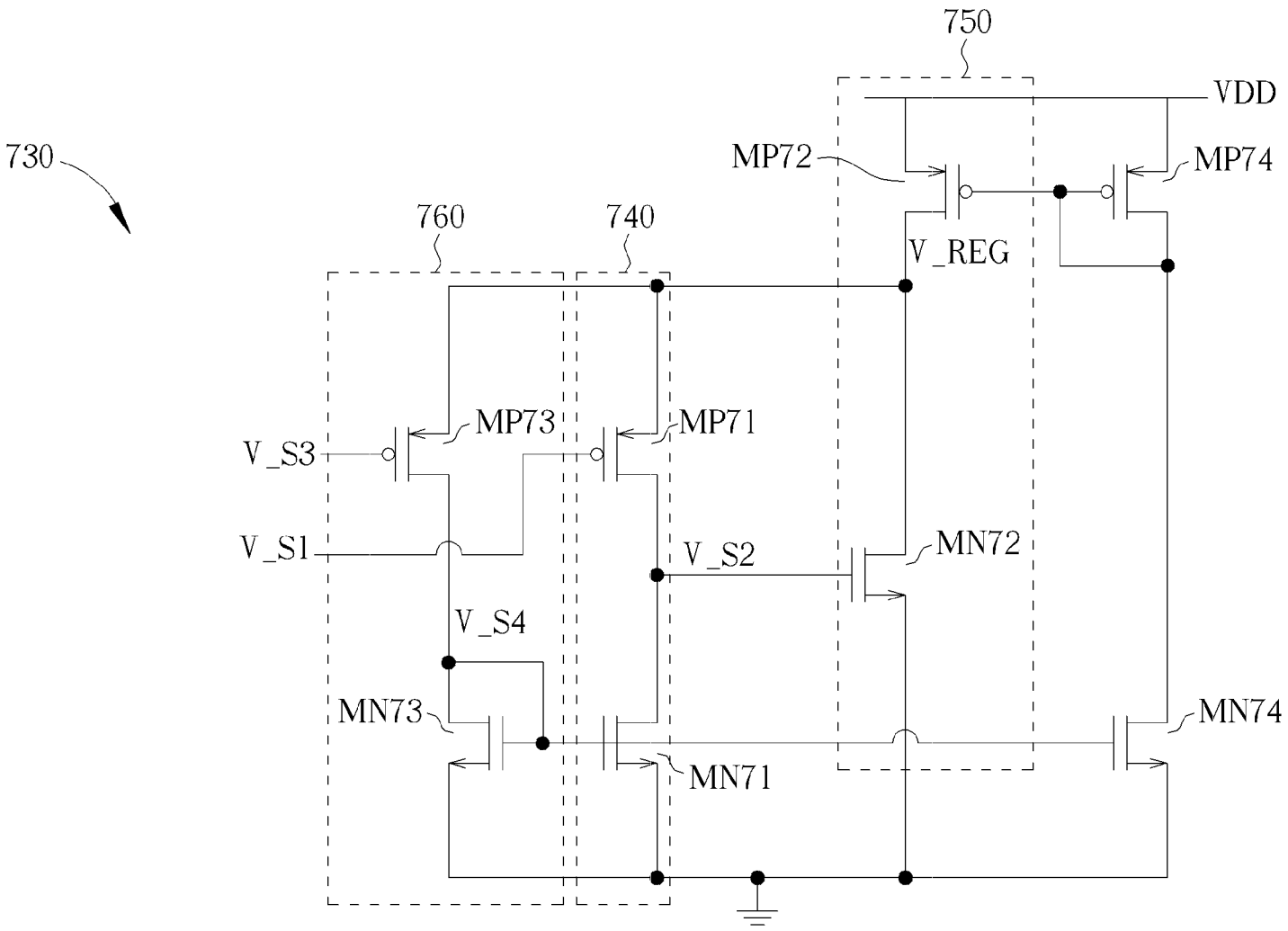
FIG. 7 is a diagram illustrating another implementation of the voltage regulation circuit shown in FIG. 6A.

Please refer to FIG. 7, which is a diagram illustrating another implementation of the voltage regulation circuit shown in FIG. 6A. The architecture of the voltage regulation circuit 730 is based on that of the voltage regulation circuit 630 shown in FIG. 6B. Specifically, the voltage regulation circuit 730 includes a first feedback circuit 740 and a second feedback circuit 750, wherein the architecture of the feedback circuit 740/750 is based on that of the feedback circuit 640/650. The main difference between the voltage regulation circuit 730 and the voltage regulation circuit 630 is that the voltage regulation circuit 730 may further include a third feedback circuit 760 and a plurality of transistors MP74 and MN74. In this implementation, the first feedback circuit 740 may include a transistor MP71 and a transistor MN71; the second feedback circuit 750 may include a transistor MP72 and a transistor MN72; and the third feedback circuit 760 may include a transistor MP73 and a transistor MN73. It should be noted that the transistor MN71 is a load of a current mirror composed of the transistor MP71, the transistor MP73 and the transistor MN73 (i.e. the load unit L1 shown in FIG. 6B). Similarly, the transistor MN72 is a load of a current mirror composed of the transistor MP72, the transistor MP74 and the transistor MN74 (i.e. the load unit L2 shown in FIG. 6B).

The first feedback circuit 740 is arranged for receiving a first specific voltage V_S1 to generate a second specific voltage V_S2, and the second feedback circuit 750 is arranged for receiving the second specific voltage V_S2 to generate a regulated voltage V_REG. In addition, the third feedback circuit 760 is arranged for receiving a third specific voltage V_S3 to generate a fourth specific voltage V_S4, and the first feedback circuit 740 further receives the fourth specific voltage V_S4 to generate the second specific voltage V_S2 accordingly. In other words, the first feedback circuit 740 generates the second specific voltage V_S2 according to at least one of the first specific voltage V_S1 and the fourth specific voltage V_S4. As shown in FIG. 7, each of the feedback circuits 740-760 included in the voltage regulation circuit 740 is a negative feedback circuit having a common-source configuration, and the disturbance (from the power supply VDD) imposed on the regulated voltage V_REG may therefore be suppressed effectively.

Figure 8:
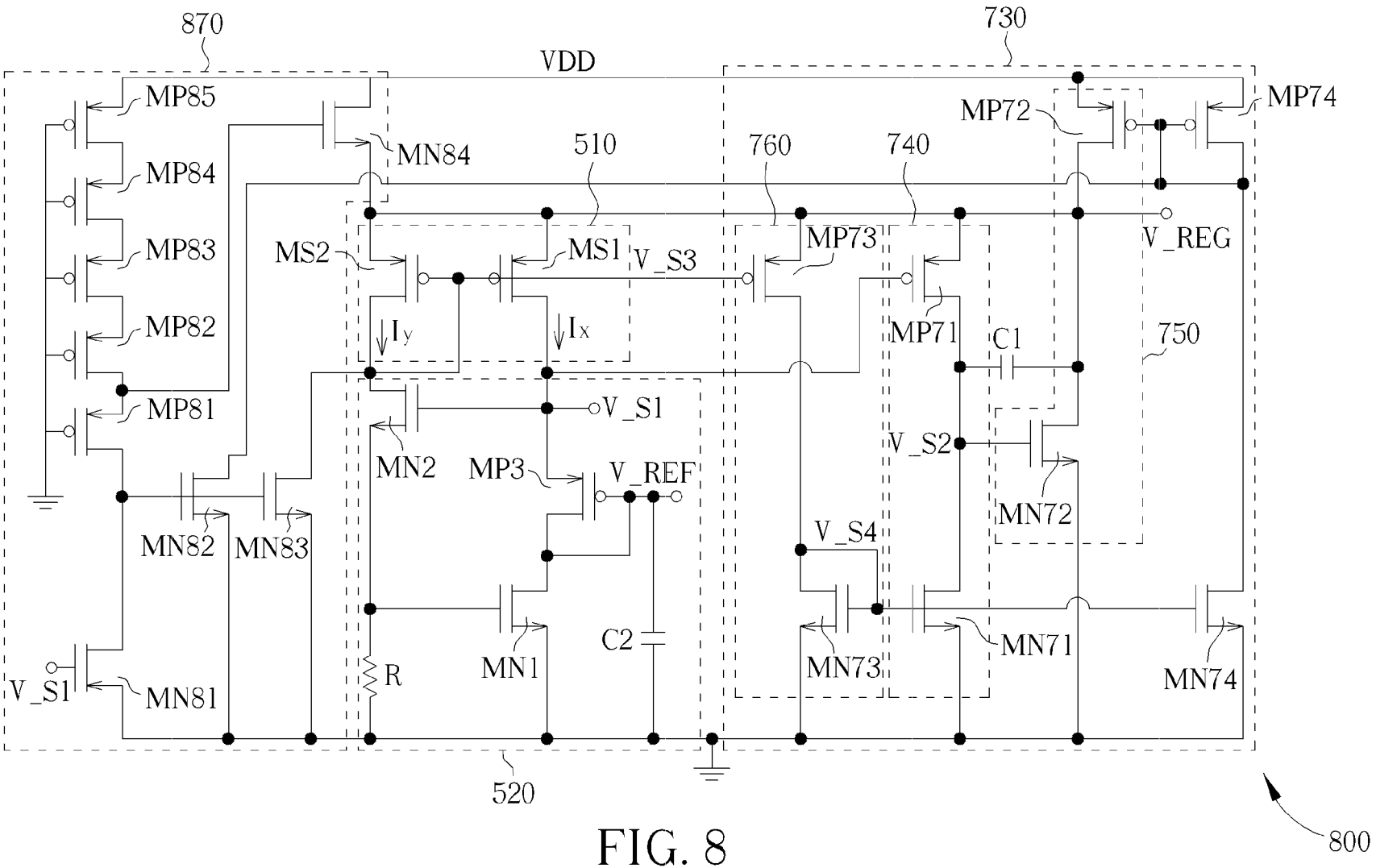
FIG. 8 is a diagram illustrating an exemplary voltage reference generation circuit according to another embodiment of the present invention.

Please refer to FIG. 8, which is a diagram illustrating an exemplary voltage reference generation circuit according to another embodiment of the present invention. In this embodiment, the voltage reference generation circuit 800 may include the current supply circuit 510 and the core circuit 520 shown in FIG. 5, the voltage regulation circuit 730 shown in FIG. 7, and a startup circuit 870. The current supply circuit 510 is coupled to the voltage regulation 730, and is arranged to receive a regulated voltage V_REG (regulated by the voltage regulation circuit 730) to provide a plurality of currents (e.g. a first current Ix and a second current Iy). The core circuit 520 is coupled to the voltage regulation circuit 730 and the current supply circuit 510, and is arranged to receive the currents (e.g. a first current Ix and a second current Iy) to generate a first specific voltage V_S1 and a voltage reference voltage V_REF. The startup circuit 870 is coupled to the current supply circuit 510, the core circuit 520 and the voltage regulation circuit 730. The startup circuit 870 includes a plurality of transistors MN81, MN82 MN83, MN84, MP81, MP82, MP83, MP84 and MP85, and is arranged to maintain the normal operation of the voltage reference generation circuit 800.

In this embodiment, the voltage regulation circuit 730 may further include a capacitor C1 coupled between the gate and the drain of the transistor MN72, wherein the capacitor C1 is arranged to enhance a PSRR of the voltage reference generation circuit 800. In addition, the core circuit 520 may further include a capacitor C2 coupled between the regulated voltage V_REG and ground. The negative feedback mechanism of the voltage regulation circuit 730 is employed to suppress the disturbance (due to ripples of the power supply VDD) in the voltage reference V_REF, and details are described as follows.

When the power supply VDD is increased due to the ripples, the regulated voltage V_REG is increased accordingly (i.e., the regulated voltage V_REG has not been regulated at this moment). In order to keep the supplied current constant, the gate voltage of the transistor MS2 would be increased. In a first feedback path, a first specific voltage V_S1 may be reduced due to the transistor MS1, and then amplified by the first feedback circuit 740 (having the common-source configuration) to increase a second specific voltage V_S2 (i.e. the gate voltage of the transistor MN72). Next, the second specific voltage V_S2 may be amplified by the second feedback circuit 750 (having the common-source configuration) to lower the regulated voltage V_REG, thereby eliminating/reducing the ripple disturbances (from the power supply VDD) in the voltage reference V_REF.

In a second feedback path, a third specific voltage V_S3 (i.e. the gate voltage of the transistor MS2) may amplified by the third feedback circuit 760 (having the common-source configuration) to lower a fourth specific voltage V_S4 (i.e. the drain voltage of the transistor MP73). Next, the fourth specific voltage V_S4 may be amplified by the first feedback circuit 740 to increase the second specific voltage V_S2, and the second specific voltage V_S2 may be amplified again by the second feedback circuit 750 to reduce the regulated voltage V_REG, thereby eliminating/reducing the ripple disturbances (from the power supply VDD) in the voltage reference V_REF.

By analyzing the voltage regulation circuit 730 with the small signal model and the Kirchhoff's law, the $PSRR_{730}$ can be derived as:

$$\left|\frac{\Delta V_REG}{\Delta VDD}\right|_{730} \approx \left|\frac{g_{ds_MP72}}{\dfrac{g_{MP71}\left(1+\dfrac{g_{MP72}}{g_{R_MN71}}\right)}{1+\dfrac{g_{ds_MN1}}{g_{ds_MS1}}}}\right|,$$

wherein the $PSRR_{730}$ is derived in decibels (dB). The $PSRR_{800}$ of the voltage reference generation circuit 800 (the sum of the $PSRR_{500}$ and the $PSRR_{730}$) may be obtained accordingly:

$$\left|\frac{\Delta V_REF}{\Delta VDD}\right|_{800} \approx \left|g_{R_MS1} \times \frac{g_B + g_{MN2}}{g_{MN1} \times g_{MP3}} - \frac{g_{R_MN2} + g_{R_MS1}}{g_{MP3}}\right| + \left|\frac{g_{ds_MP72}}{\dfrac{g_{MP71}\left(1+\dfrac{g_{MN72}}{g_{R_MN71}}\right)}{1+\dfrac{g_{ds_MN1}}{g_{ds_MS1}}}}\right|,$$

wherein the $PSRR_{800}$ is derived in decibels (dB); $g_{R_MS1}$, $g_{R_MN2}$ and $g_{R_MN71}$ are output conductances of the transistor MS1, MN2 and MN71, respectively; $g_B$ is a reciprocal of the resistor R; $g_{MN1}$, $g_{MN2}$, $g_{MP3}$, $g_{MP71}$ and $g_{MN72}$ are transconductances of the transistors MN1, MN2, MP3, MP71 and MN72, respectively; and $g_{ds_MS1}$, $g_{ds_MN1}$ and $g_{ds_MP72}$ are drain-to-source conductances of the transistors MS1, MN1 and MP72, respectively.

Figure 9:
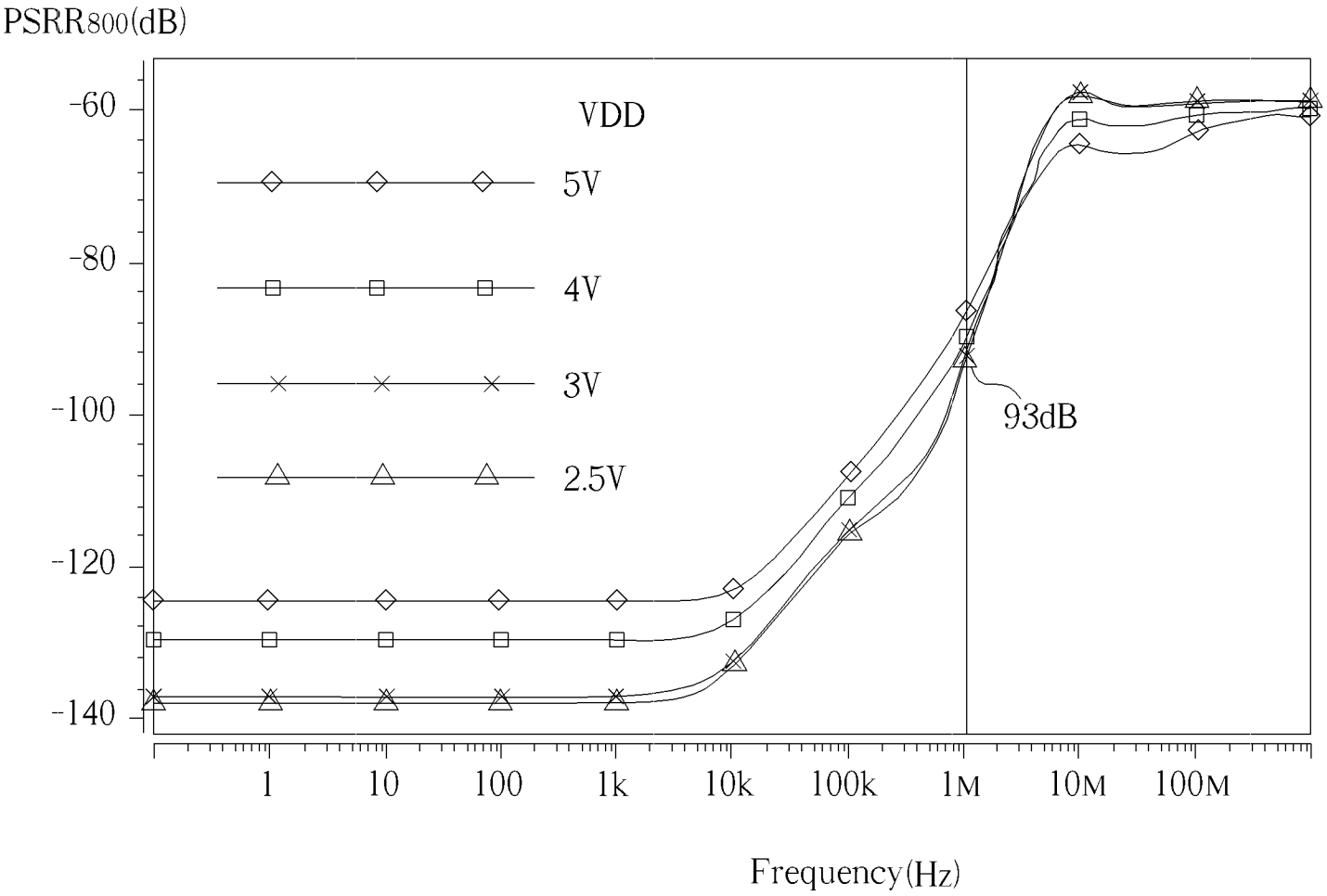
FIG. 9 is a diagram illustrating a simulation relationship between the PSRR and the frequency for the voltage reference generation circuit operated in different power supply voltages.
Figure 10:
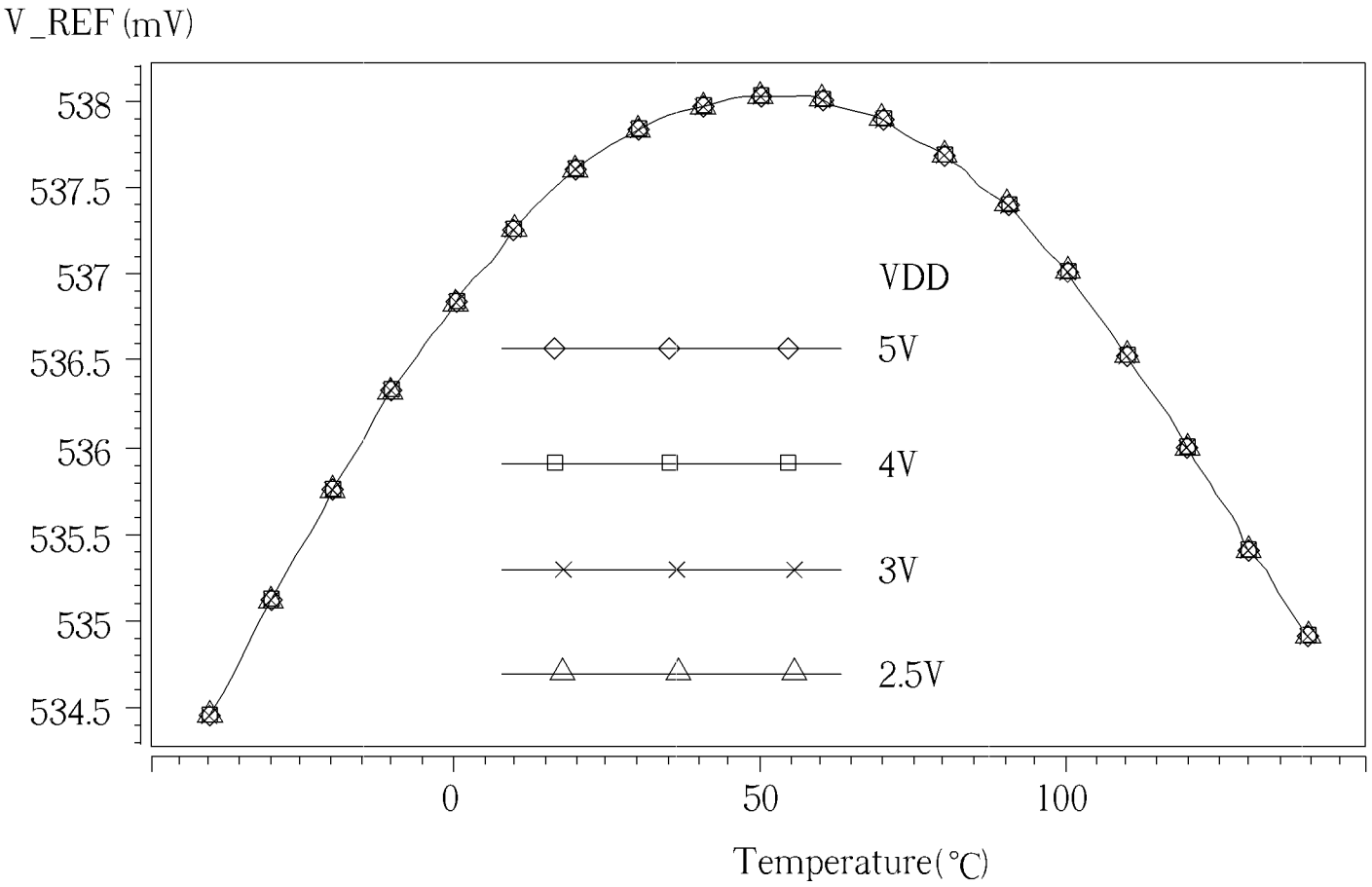
FIG. 10 is a diagram illustrating a simulation relationship between the voltage reference and the temperature for the voltage reference generation circuit operated in different power supply voltages.
Figure 11:
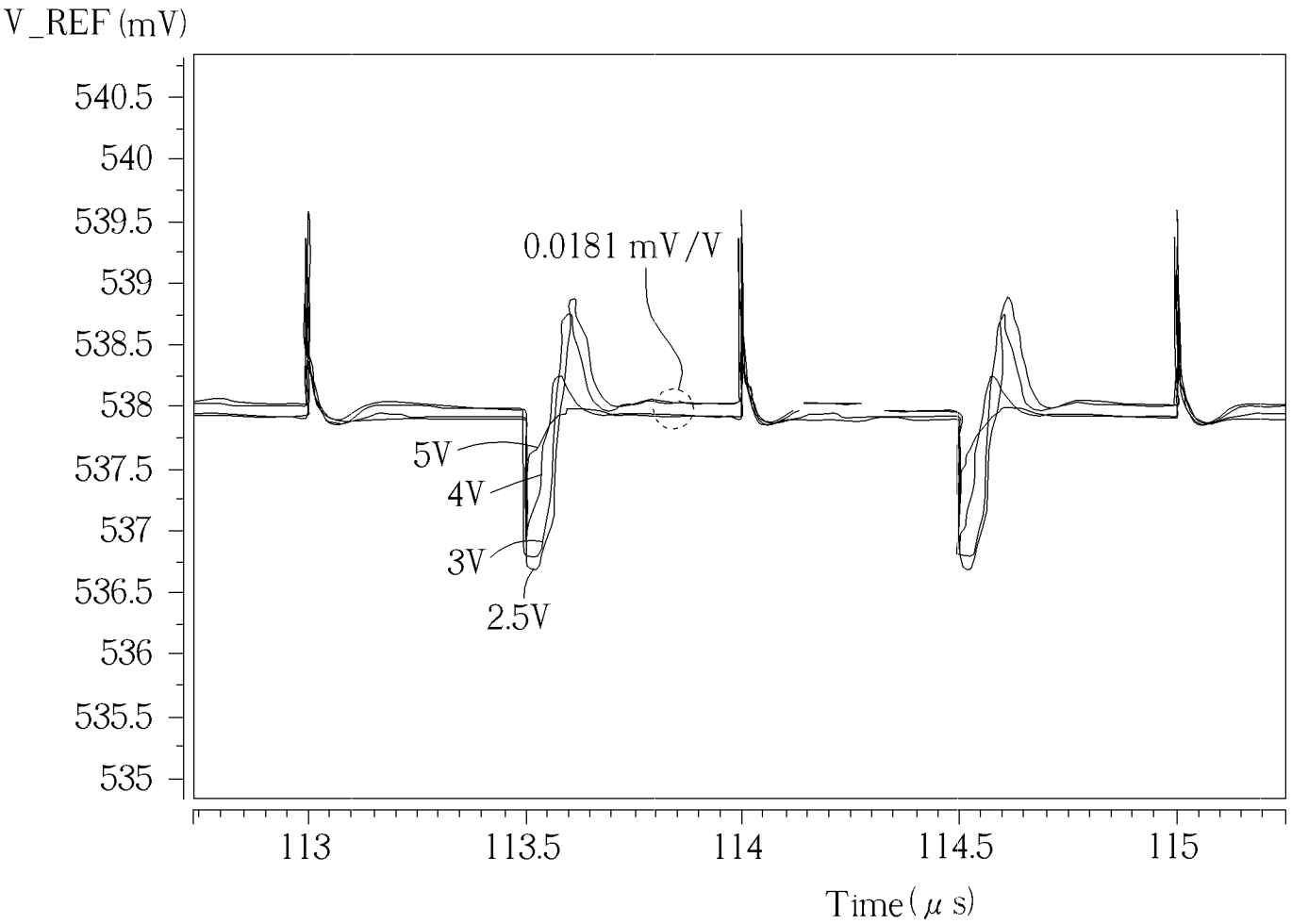
FIG. 11 is a diagram illustrating a relationship between the voltage reference and the time for the voltage reference generation circuit operated in different power supply voltages.

Please refer to FIG. 9, which is a diagram illustrating a simulation relationship between the $PSRR_{800}$ and the frequency for the voltage reference generation circuit 800 operated in different power supply voltages. The simulation relationship is obtained based on the derived expressions. As shown in FIG. 9, the $PSRR_{800}$ may be higher 120 dB in low operation frequencies, and around 90 dB even in 1 MHz operation frequency (in a case where the power supply VDD is lower). Please refer to FIG. 10, which is a diagram illustrating a simulation relationship between the voltage reference V_REF and the temperature for the voltage reference generation circuit 800 operated in different power supply voltages. The simulation relationship is obtained based on the derived expressions. As shown in FIG. 10, it reveals that the voltage reference V_REF (in millivolts (mV)) has a very low temperature coefficient even if the power supply VDD changes the supplied voltage. Please refer to FIG. 11, which is a diagram illustrating a relationship between the voltage reference V_REF (in millivolts (mV)) and the time (in microseconds (μs)) for the voltage reference generation circuit 800 operated in different power supply voltages. The relationship is obtained by imposing a voltage pulse (from +0.5V to −0.5V) to test line regulation of the voltage reference generation circuit 800. As shown in FIG. 11, the line regulation of the voltage reference generation circuit 800 (operated in 1 MHz) is $$\frac{1.806 \times 10^{-5}\ \text{V}}{1\ \text{V}} = 0.0181\ \text{mV/V}.$$

In other words, the line regulation of the voltage reference generation circuit 800 is excellent.

In summary, the proposed voltage generation circuit may generate a voltage reference with a low temperature coefficient by cascading and arranging a plurality of transistors appropriately, wherein transistor(s) having common-gate configuration(s) may be employed to extend the bandwidth. In addition, the proposed voltage reference generation circuit also employs a voltage regulation circuit, including at least two common-source feedback circuits, to enhance a PSRR of the voltage reference generation circuit, wherein each of the feedback circuits included in the voltage regulation circuit may be a negative feedback circuit. Thus, the PSRR of the voltage reference generation circuit can be enhanced greatly, and the voltage reference generation circuit can be applied in wideband applications (e.g. a voltage regulator in a radio frequency (RF) system) In addition, the proposed voltage reference generation circuit may also be applied in a low dropout linear regulator (LDO). In brief, the proposed voltage reference generation circuit has a low temperature coefficient, a wideband high PSRR, low fabrication cost, a weak body effect and/or low line regulation, and therefore provides a solution to power supply noise suppression in wideband application.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage reference generation circuit, comprising:

a current supply circuit, for providing a plurality of currents; and a core circuit, coupled to the current supply circuit, for receiving the currents and generating a voltage reference according to the received currents, wherein the core circuit comprises a first transistor, a second transistor and a third transistor; the first transistor and the third transistor generate a first gate-to-source voltage and a third gate-to-source voltage, respectively, according to a first current of the received currents; the second transistor generates a second gate-to-source voltage according to a second current of the received currents; and the voltage reference is generated according to the first gate-to-source voltage, the second gate-to-source voltage and the third gate-to-source voltage.

2. The voltage reference generation circuit of claim 1, wherein the first transistor comprises a first gate, a first drain and a first source; the second transistor comprises a second drain, a second gate and a second source, wherein the second drain receives the second current, and the second source is coupled to the first gate; and the third transistor comprises a third gate, a third drain and a third source, wherein the third source receives the first current, the third source is coupled to the second gate, and the third gate and the third drain are coupled to the first drain.

3. The voltage reference generation circuit of claim 2, wherein a doping type of the third transistor is different from doping types of the first transistor and the second transistor.

4. The voltage reference generation circuit of claim 2, wherein the core circuit further comprises:

a resistive element, coupled between the first source and the first gate.

5. The voltage reference generation circuit of claim 1, wherein the current supply circuit is a current mirror circuit which provides only the first current and the second current to the core circuit.

6. The voltage reference generation circuit of claim 1, wherein the core circuit determines the voltage reference according to the first current and the second current only.

7. The voltage reference generation circuit of claim 1, wherein the voltage reference is determined by a specific combination of the first gate-to-source voltage, the second gate-to-source voltage and the third gate-to-source voltage, and the specific combination is:

$$|VGS1|+|VGS2|-|VGS3|;$$

wherein VGS1 is the first gate-to-source voltage, VGS2 is the second gate-to-source voltage, and VGS3 is the third gate-to-source voltage.

8. The voltage reference generation circuit of claim 1, further comprising:

a voltage regulation circuit, coupled to the current supply circuit and the core circuit, wherein the voltage regulation circuit comprises:

a first feedback circuit, having a common-source configuration, for receiving at least a first specific voltage to generate a second specific voltage, wherein the first specific voltage is generated according to an unregulated voltage; and a second feedback circuit, having a common-source configuration, for receiving the second specific voltage to generate a regulated voltage;

wherein the current supply circuit receives the regulated voltage to provide the currents, and the core circuit further generates the first specific voltage according to the received currents.

9. The voltage reference generation circuit of claim 8, wherein each of the first feedback circuit and the second feedback circuit is a negative feedback circuit.

10. The voltage reference generation circuit of claim 8, wherein the voltage regulation circuit further comprises:

a third feedback circuit, for receiving a third specific voltage to generate a fourth specific voltage, wherein the first feedback circuit further receives the fourth specific voltage and generates the second specific voltage according to at least one of the first and fourth specific voltages.

11. The voltage reference generation circuit of claim 10, wherein each of the first feedback circuit, the second feedback circuit and the third feedback circuit is a negative feedback circuit.

12. The voltage reference generation circuit of claim 10, wherein the third feedback circuit has a common-source configuration.

13. The voltage reference generation circuit of claim 8, wherein the first feedback circuit and/or the second feedback circuit comprises at least a transistor, and a source of the transistor and a body of the transistor are at equal potential.

14. A voltage reference generation method, comprising:

providing a plurality of currents;

using a first transistor and a third transistor to generate a first gate-to-source voltage and a third gate-to-source voltage, respectively, according to a first current of the received currents;

using a second transistor to generate a second gate-to-source voltage according to a second current of the received currents; and generating a voltage reference according to the first gate-to-source voltage, the second gate-to-source voltage and the third gate-to-source voltage;

wherein the voltage reference is determined by a specific combination of the first gate-to-source voltage, the second gate-to-source voltage and the third gate-to-source voltage, and the specific combination is:

$$|VGS1|+|VGS2|-|VGS3|;$$

wherein VGS1 is the first gate-to-source voltage, VGS2 is the second gate-to-source voltage, and VGS3 is the third gate-to-source voltage.

15. The voltage reference generation method of claim 14, further comprising:

using a first feedback circuit having a common-source configuration to receive a first specific voltage and accordingly generate a second specific voltage, wherein the first specific voltage is generated according to an unregulated voltage; and using a second feedback circuit having a common-source configuration to receive a second specific voltage and accordingly generate a regulated voltage;

wherein the step of providing the currents comprises:

receiving the regulated voltage to provide the currents, and receiving the currents to generate the first specific voltage.

16. The voltage reference generation method of claim 15, further comprising:

using a third feedback circuit to receive a third specific voltage to accordingly generate a fourth specific voltage;

wherein the step of receiving the second specific voltage and accordingly generating the regulated voltage comprises:

receiving the fourth specific voltage, wherein the second specific voltage is generated according to at least one of the first and fourth specific voltages.

* * * * *